US006179507B1

(12) United States Patent
Lam

(10) Patent No.: US 6,179,507 B1
(45) Date of Patent: Jan. 30, 2001

(54) PERMANENTLY LOCKING RING BINDER

(75) Inventor: Wan Yip Lam, Tuen Mun (HK)

(73) Assignee: Hong Kong Stationery Manufacturing Co., Ltd., Kowloon (HK)

( * ) Notice: Under 35 U.S.C. 154(b), the term of this patent shall be extended for 0 days.

(21) Appl. No.: 09/458,067

(22) Filed: Dec. 10, 1999

(51) Int. Cl.[7] ..... B42F 13/20; B42F 3/00

(52) U.S. Cl. ..... 402/36; 402/2; 402/65; 402/80 R

(58) Field of Search ..... 402/36, 2, 45, 402/60, 71, 73, 75, 63–66, 54, 55, 56, 52, 48

(56) References Cited

U.S. PATENT DOCUMENTS 1,513,518 * 10/1924 Pott .
1,558,807 * 10/1925 Horn .
2,371,474 * 3/1945 Seelman .
2,502,275 * 3/1950 Perlin .
3,262,455 * 7/1966 Shillinger .
4,180,340 * 12/1979 Cosby ..... 402/63
4,307,972 * 12/1981 Errichiello ..... 402/73
4,874,186 * 10/1989 Groswith, III et al. ..... 281/28
4,997,208 * 3/1991 Staats, III ..... 281/28
5,074,696 * 12/1991 Tanaka ..... 402/52
5,224,788 * 7/1993 Freed ..... 402/58
5,281,040 * 1/1994 Hodkin et al. ..... 402/56
5,423,624 * 6/1995 Richards ..... 402/13
5,509,745 * 4/1996 Hegarty ..... 402/2
5,549,203 * 8/1996 Weisburn et al. ..... 402/68
5,653,544 * 8/1997 Cabre Pijoan et al. ..... 402/64

* cited by examiner

*Primary Examiner*—A. L. Wellington
*Assistant Examiner*—Alisa L. Thurston
(74) *Attorney, Agent, or Firm*—Shoemaker and Mattare LTD

(57) ABSTRACT

A permanently locking ring binder includes a housing, a pair of hinged plates within the housing, each supporting a plurality of ring segments arranged so that, when the plates are in one position, the ends of the ring segments are spaced apart, so that one can insert loose-leaf papers over the segments, and a second position, in which the ends of opposing ring segments meet, forming closed rings for retaining the papers. The binder has an initially inactive lock which can be activated once papers have been placed in the binder, to prevent movement of the rings to their open position. The lock cannot be manually deactivated.

5 Claims, 7 Drawing Sheets

PERMANENTLY LOCKING RING BINDER

BACKGROUND OF THE INVENTION

This invention relates to a permanently locking ring binder for loose-leaf papers.

The common ring binder has a metal shell containing a pair of hinged plates, each supporting a number of semi-circular ring segments that protrude through or around the shell. The plates can be toggled, by manipulating either the rings or a release lever, between a closed configuration in which the ends of the ring segments meet, and an open position where the ends of the rings are spaced apart, permitting papers that have been inserted to be removed. The ability to toggle between open and closed configurations repeatedly is normally a requirement, and certainly the great advantage of this type of binder.

Sometimes, however, papers ought not to be removed from ring binders. An example is at a sales counter catalog binder, where the value of catalogs in a binder is diminished if any papers (e.g., price lists) are removed from the binder. People are won't to borrow papers for various reasons; the papers may then be lost or improperly refilled, notwithstanding the good intentions of the borrower. Archival collections would also benefit from permanently locking binders.

It would therefore be beneficial to have a binder which could be permanently locked to prevent removal of papers from the binder.

SUMMARY OF THE INVENTION

An object of the invention is to provide a ring binder which can be opened and closed repeatedly only until a permanent lock has been activated to prevent further opening of the binder.

Another object is to provide a permanent lock for a ring binder which can be activated simply by pressing on the lock with the finger.

A further object is to provide a permanent ring binder lock which can be applied to existing ring binder designs with no alterations except for forming apertures in the binder shell.

These and other objects are attained by a permanently locking ring binder comprising a housing, a pair of hinged plates within the housing, each supporting a plurality of ring segments arranged so that, when the plates are in one position, the ends of the ring segments are spaced apart, so that one can insert loose-leaf papers over the segments, and a second position, in which the ends of opposing ring segments meet, forming closed rings for retaining the papers, and an initially inactive lock which can be activated once papers have been placed in the binder, to prevent movement of the rings to their open position, which lock cannot be manually deactivated.

BRIEF DESCRIPTION OF THE DRAWINGS

In the accompanying drawings.

DESCRIPTION OF THE PREFERRED EMBODIMENT

Figure 1:
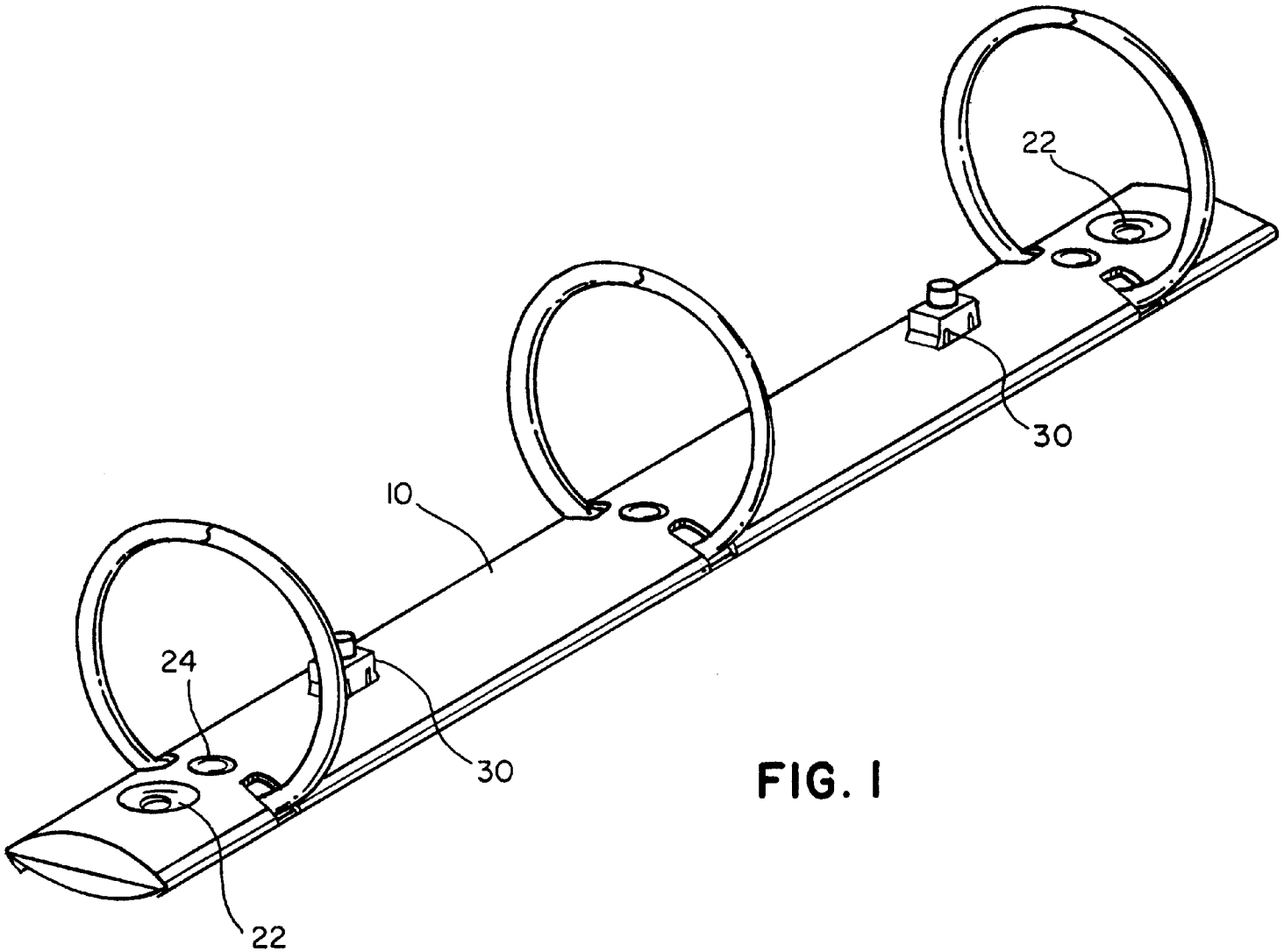
FIG. 1 is a isometric view of a permanently locking ring binder embodying the invention, with the ring segments closed.
Figure 2:
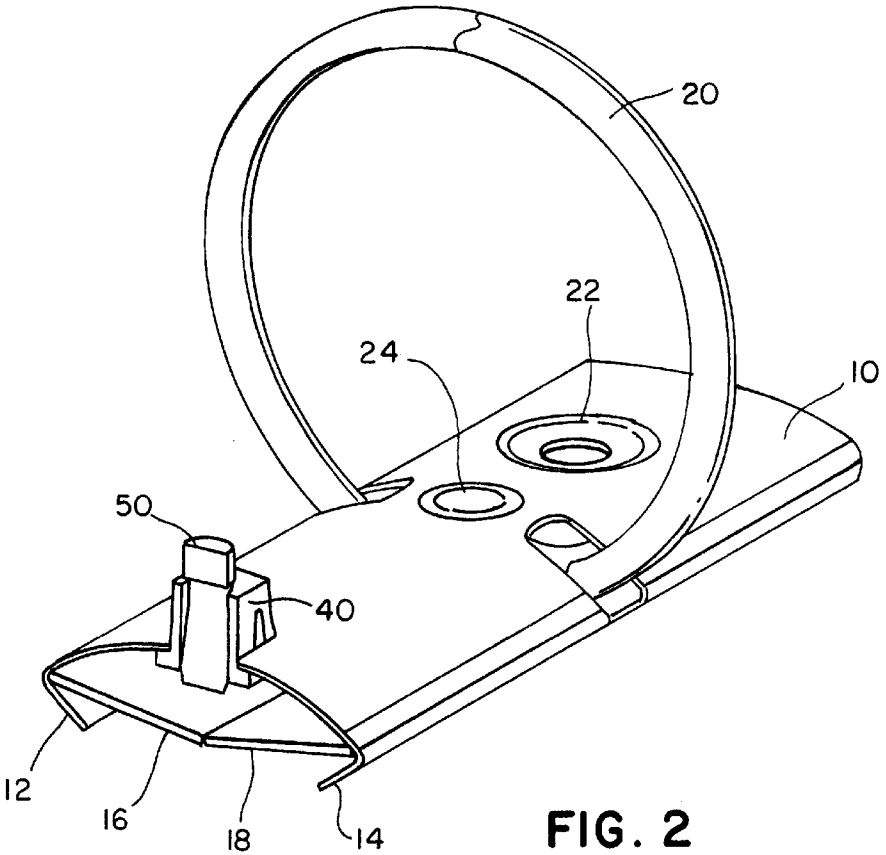
FIG. 2 is an isometric view at an enlarged scale of a portion of the ring binder, cut away on a vertical plane through a permanent lock to show the structure of the lock.
Figure 3:
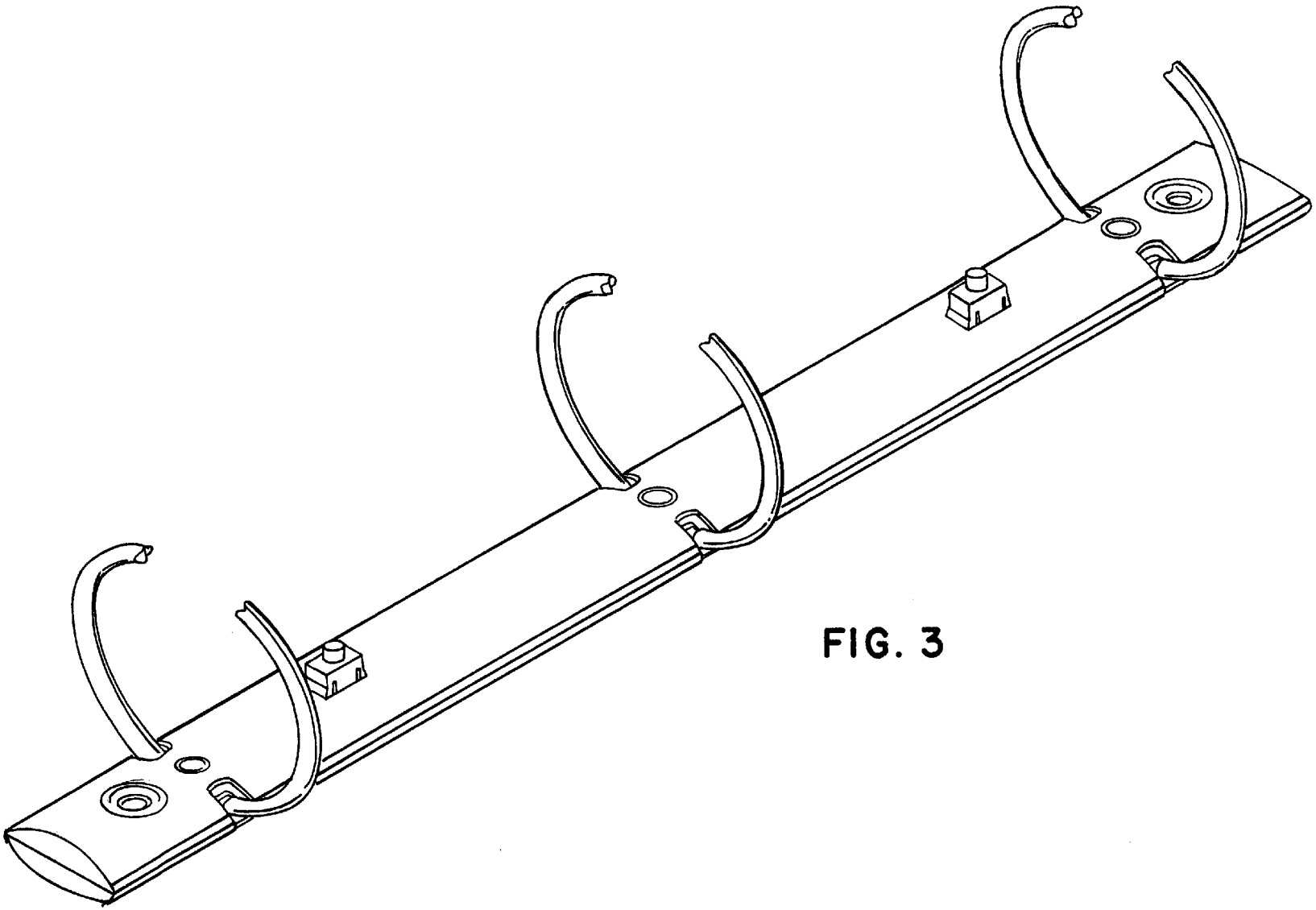
FIG. 3 is a view like FIG. 1, showing the ring binder in its open configuration.

A permanently locking ring binder embodying the invention includes, as seen in FIGS. 1 and 2, an upwardly convex metal shell or housing 10 whose lateral edges 12, 14 are turned downwardly and inwardly, forming vees which serve a fulcrum lines for the outer edges of respective hinged blades 16, 18. The mating edges of the blades are kept in alignment by small interdigitating protrusions, not shown. Three ring segments 20 extend upward from each of the blades. Their bottom ends are secured in holes in the blades by swaging, staking or other well-known methods. The upper ends of the rings meet, in FIGS. 1 and 2, and this contact limits the inward movement of the ring segments. The blades and shell are designed so that, even in this configuration, the combined blade width is slightly greater than the distance between the vees, and the shell material is slightly stressed, being slightly flattened from its natural convex shape.

The shell is attached to a notebook or the like by means of rivets 22 or other devices. The manner of attachment is not important to this invention.

Figure 4:
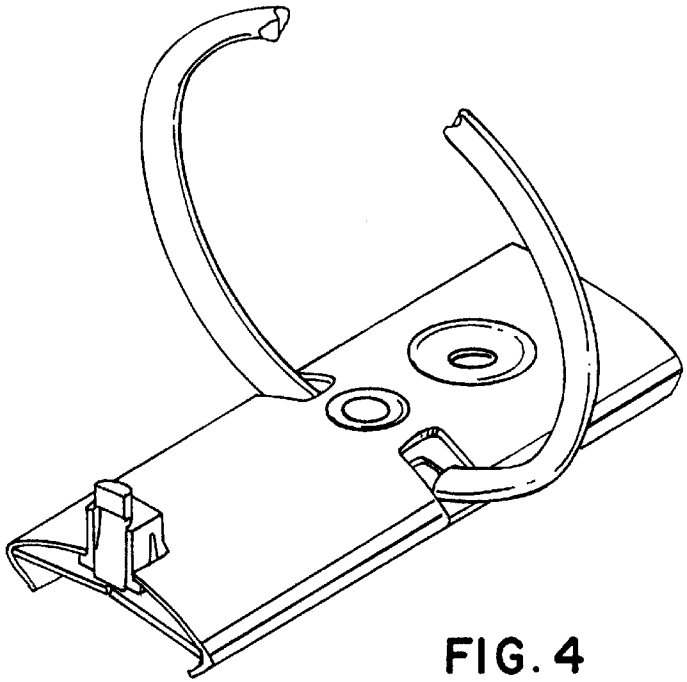
FIG. 4 is a view like FIG. 2, showing the lock in its inactive position.
Figures 5, 6:
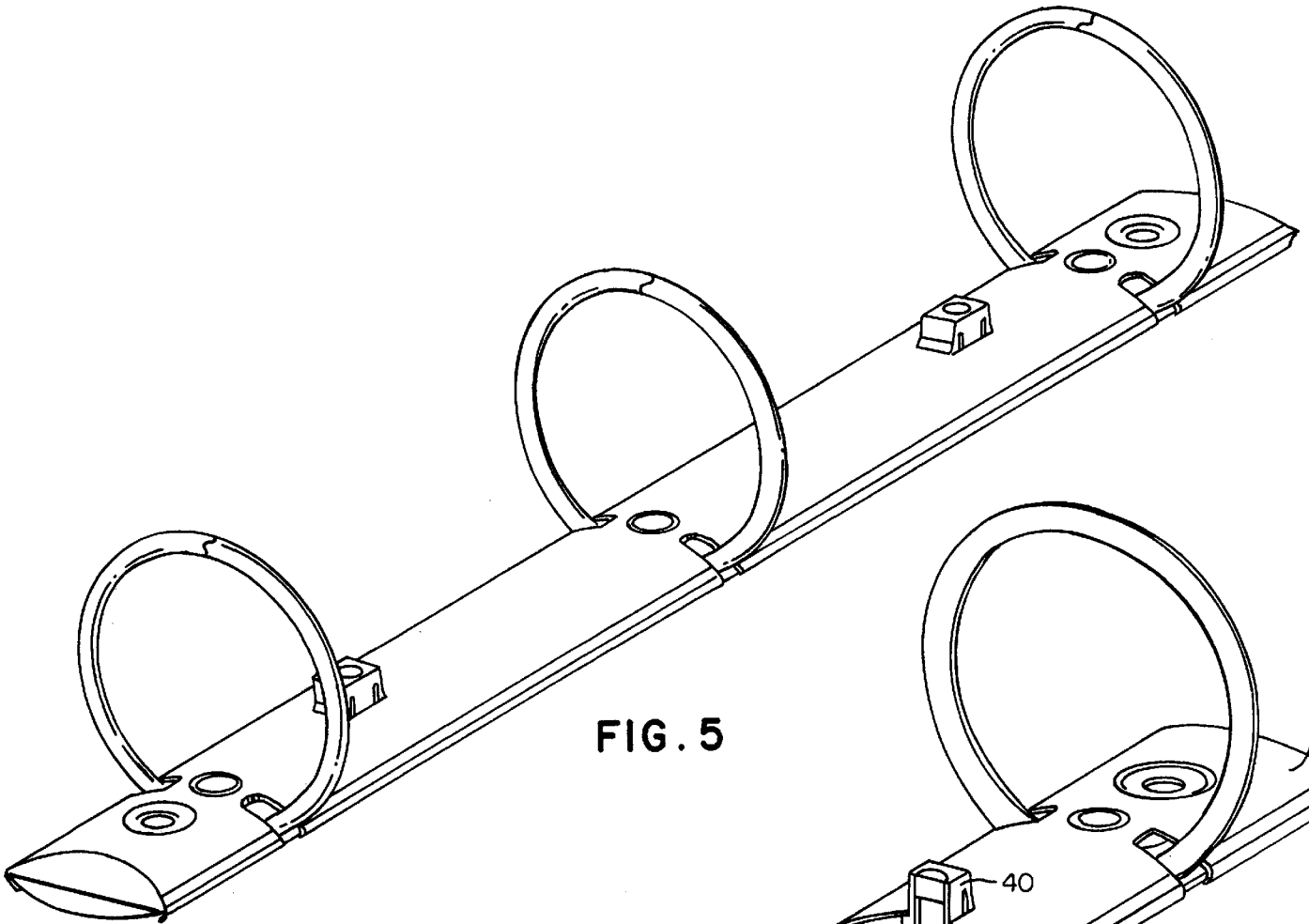
FIG. 5 is a view like FIG. 1, but showing the locks activated to prevent reopening of the binder.
FIG. 6 is a view like FIG. 2, showing the lock in its active position.

One can open the rings by pulling outward on the segments. This causes the blades to move from their initial positions, in which there is a positive dihedral angle between the plates, through a coplanar configuration, where the shell is under maximum bending stress (i.e., most greatly flattened), then to an open configuration where the inner edges of the blades meet the shell or a stop such as the dimples 24 shown. The open position is shown in FIGS. 4 and 5.

The drawings show a pair of permanent locks 30 protruding from the top surface of the shell. Only one lock may be needed, but having plural locks reduces the likelihood that the rings at one end could be opened once a single lock were activated.

Figure 7:
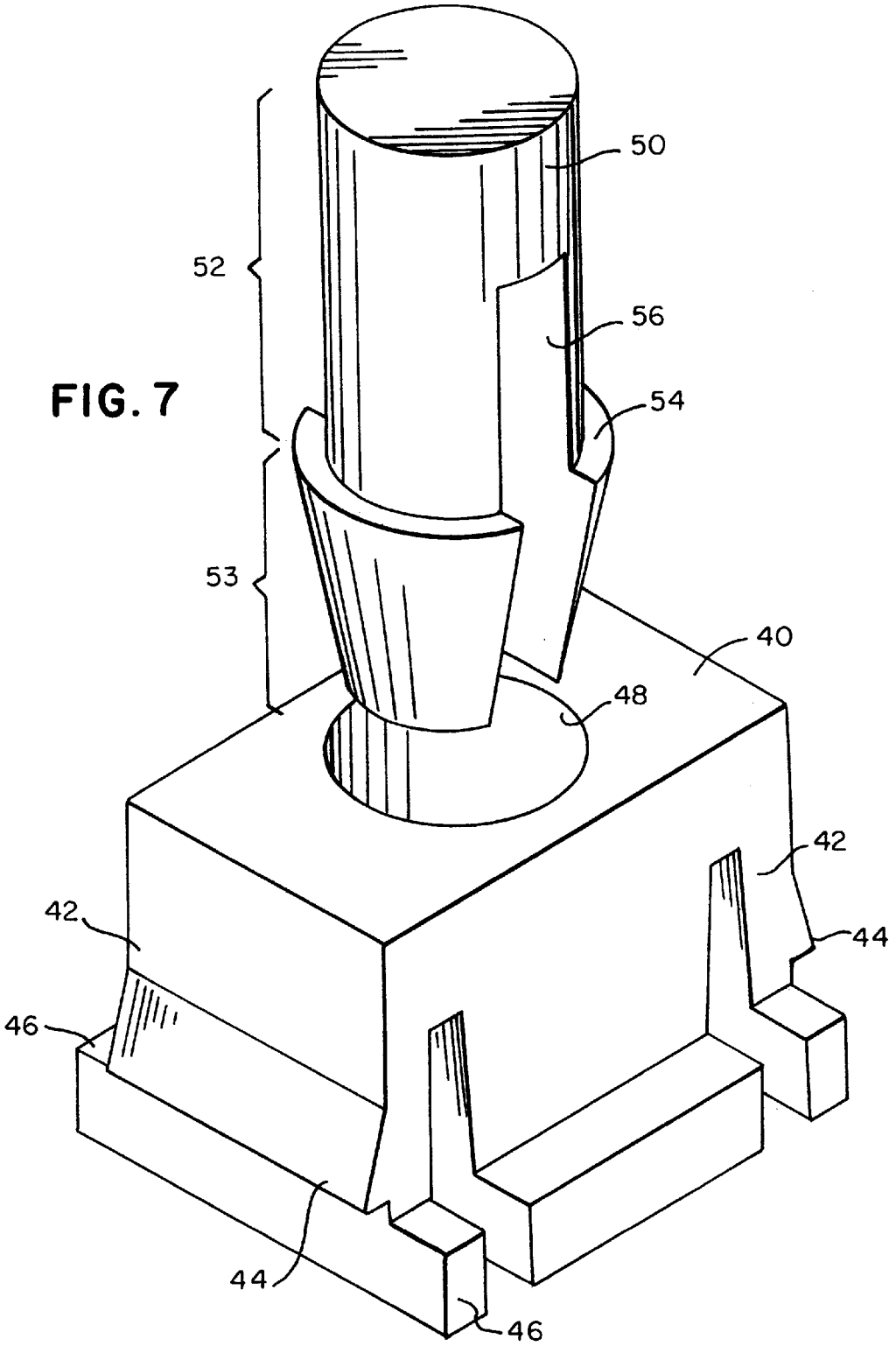
FIG. 7 is an exploded isometric view of one of the locks shown in FIGS. 1–6.
Figure 8:
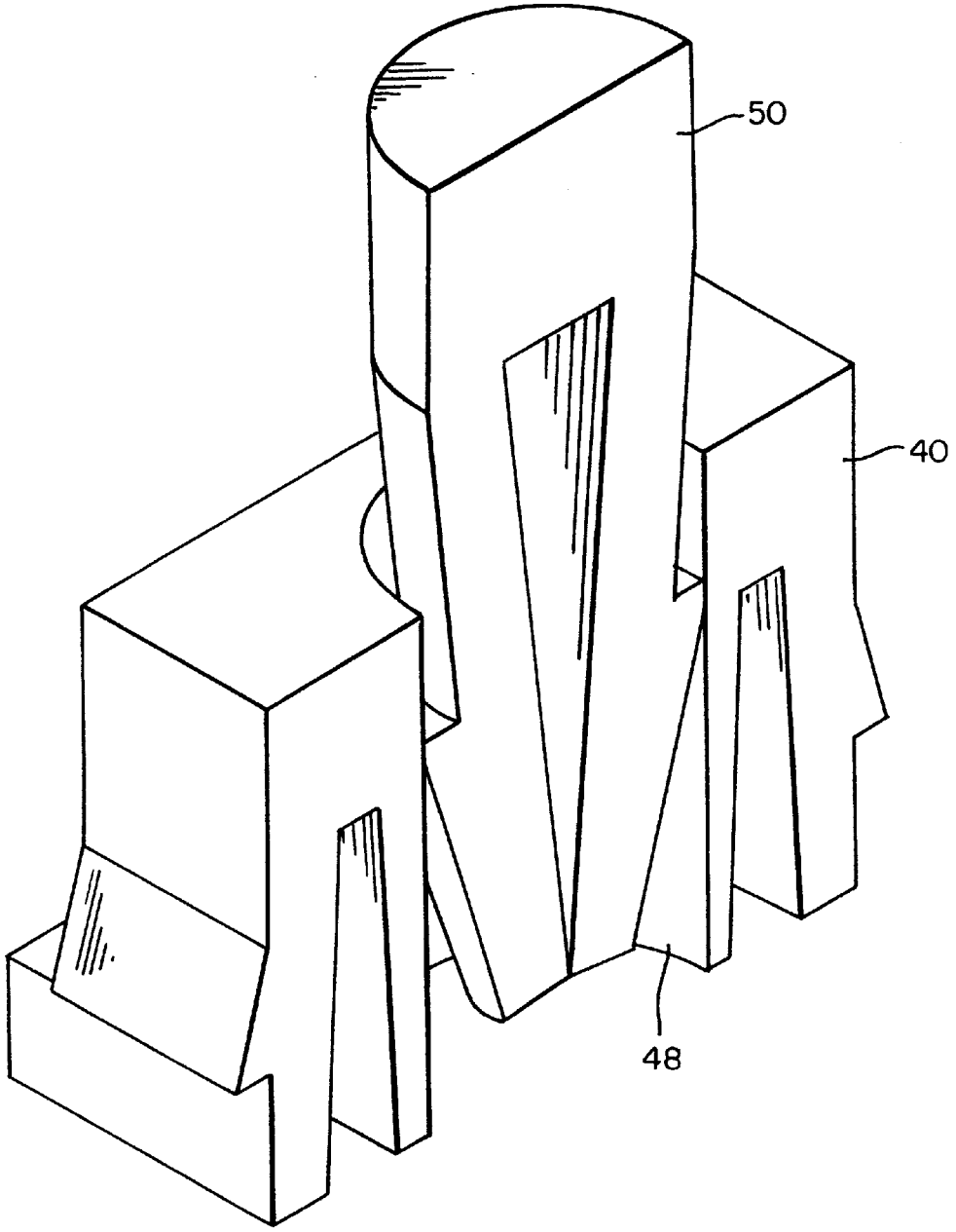
FIG. 8 is a cross-section, taken on a vertical plane containing the axis of the lock plunger, with the lock in its inactive initial configuration.
Figure 9:
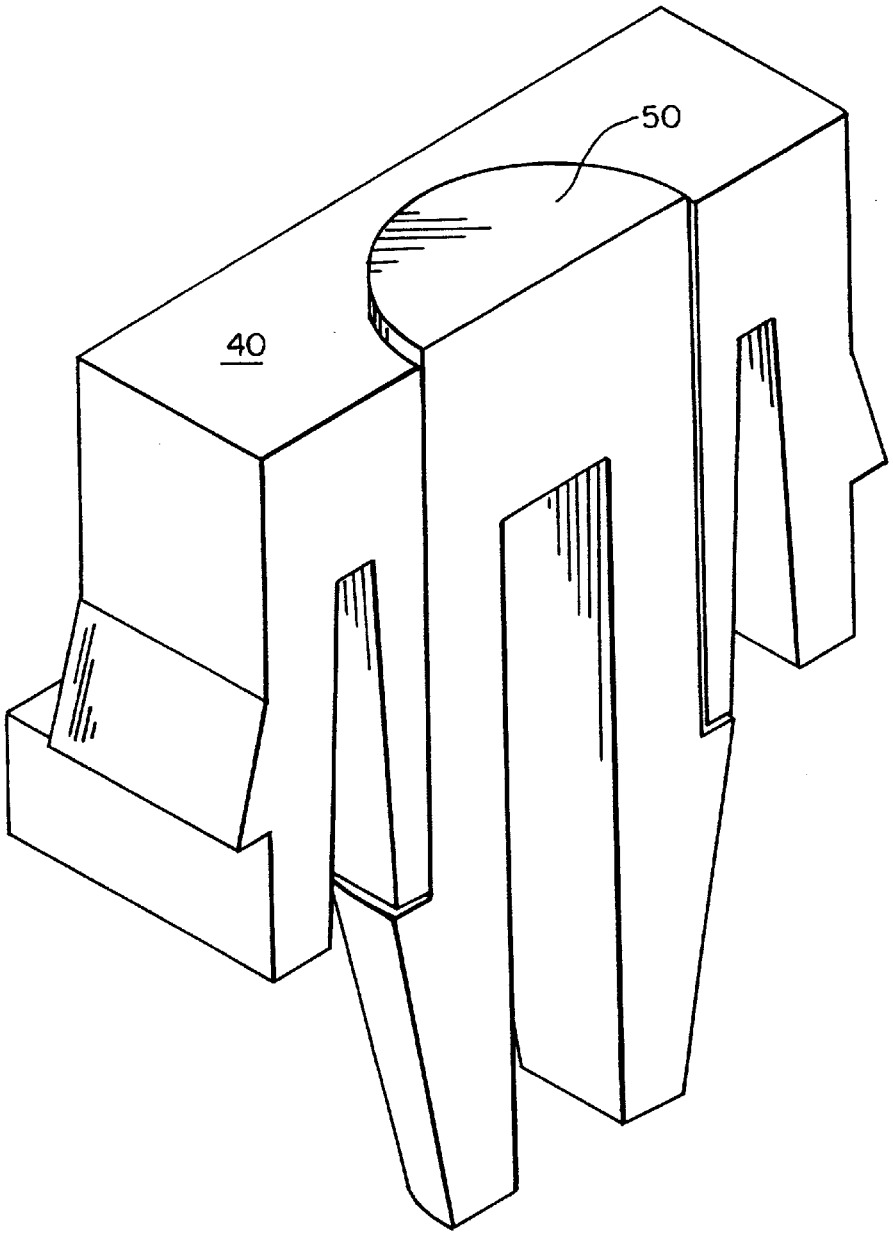
FIG. 9 is a view like FIG. 8, showing the lock in its depressed and active configuration.

FIGS. 7–9 illustrate one of the locks in detail. The lock 30 includes a body 40 and a plunger 50. The body, which has a rectangular cross-section, is provided with a pair of downwardly-extending spring arms 42. Each of the arms has a triangular bulge or tang 44 extending outwardly away from the body, and a pair of fingers 46 extending in opposite directions from the bottom end of the arm. The shell is provided with rectangular apertures similar in size and shape to the cross-section of the body, so that the lock can be installed by pressing the body upward through the aperture. The tangs force the arms inward as they pass through the aperture, and when the body is fully seated, its fingers engaging the bottom of the shell, the arms spring outward, locking the tangs above the shell. After the body is in place in the aperture, a plug (not shown) made of plastic or metal may be wedged into the space between each arm and the body, to prevent people from defeating the purpose of the invention by prying the permanent lock out of the aperture.

The plunger 50 is inserted from above into the circular hole 48 extending vertically through the body. The plunger has a cylindrical upper portion 52 having a sliding fit in the hole 48, and a somewhat larger tapered lower portion 53 which has a circumferential shoulder 54. The kerf 56 extending laterally through the plunger permits the spaced ends of the lower portion 53 to deform inwardly as the plug is inserted into the bore. Friction between the periphery of the shoulder 54 and the bore 48 initially keeps the plunger in its upward or inactive position, out of contact with the blades below. When, however, one wants to activate the lock, one simply depresses the plunger with the finger until the enlarged portion of the plunger extends beyond he body, and the shoulder locks under the bottom edge of the bore. At this point, it is impossible to retract the plunger, and besides, the top of the plunger is now flush with the top of the body, so it cannot be grasped in any event. The bottom of the plunger now lies just above the inner edges of the blades 16, 18 (see FIG. 6), preventing them from moving upward, and frustrating any attempt to remove papers from the binder.

Since the invention is subject to modifications and variations, it is intended that the foregoing description and the accompanying drawings shall be interpreted as only illustrative of the invention defined by the following claims.

I claim:

1. A permanently locking ring binder for loose-leaf papers, said binder comprising a housing having lateral edges, a pair of hinged plates confined within the housing between said edges, a plurality of ring segments affixed to each of said plates, said ring segments being arranged so that, when the plates are in one position, the ends of the ring segments are spaced apart and one can insert loose-leaf papers over the segments, and a second position, in which the ends of opposing ring segments meet, forming closed rings for retaining the papers, and at least one initially inactive lock affixed to the housing which can be activated once papers have been placed in the binder, to prevent movement of the rings to their open position, which lock cannot be deactivated, said lock comprising a body extending through the housing and a plunger movable within the body to a depressed permanently latched position wherein the bottom surface of the plunger rests just above the inner edges of the plates thus preventing the blades from moving.

2. The invention of claim 1, wherein said plunger has an enlarged portion which permanently latches against a bottom edge of the bore when the plunger is sufficiently depressed.

3. The invention of claim 1, wherein the plunger has an upper surface which is flush with an upper surface of the body when the plunger reaches its permanently latched position.

4. The invention of claim 2, wherein the housing has at least one aperture, one for each of said locks, and the aperture has a shape corresponding to the cross-section of the lock, so that the lock can be inserted into the aperture.

5. The invention of claim 4, wherein the body has at least one spring arm with a tang thereon and at least one stop below the tang, whereby when the body is pressed into the aperture, the stop limits the movement of the body, and the tang thereafter prevents removal of the body from the aperture.

* * * * *